US011737174B2

(12) United States Patent
Walz et al.

(10) Patent No.: US 11,737,174 B2
(45) Date of Patent: Aug. 22, 2023

(54) PTC HEATING ELEMENT AND ELECTRIC HEATING DEVICE COMPRISING SUCH

(71) Applicant: Eberspächer catem GmbH & Co. KG, Herxheim (DE)

(72) Inventors: Kurt Walz, Hagenbach (DE); Ahmad Asafi, Karlsruhe (DE)

(73) Assignee: Eberspächer catem GmbH & Co. KG, Herxheim (DE)

( * ) Notice: Subject to any disclaimer, the term of this patent is extended or adjusted under 35 U.S.C. 154(b) by 564 days.

(21) Appl. No.: 16/828,292

(22) Filed: Mar. 24, 2020

(65) Prior Publication Data

US 2020/0314965 A1 Oct. 1, 2020

(30) Foreign Application Priority Data

Mar. 28, 2019 (DE) ..... 102019204401.8

(51) Int. Cl.
*H05B 3/28* (2006.01)
*H05B 3/32* (2006.01)

(52) U.S. Cl.
CPC ..... *H05B 3/286* (2013.01); *H05B 3/32* (2013.01); *H05B 2203/02* (2013.01); *H05B 2203/023* (2013.01)

(58) Field of Classification Search
CPC . H05B 3/286; H05B 3/32; H05B 3/06; H05B 3/265; H05B 3/22; H05B 3/02;
(Continued)

(56) References Cited

U.S. PATENT DOCUMENTS 7,378,614 B2 * 5/2008 Lee ..... H05B 3/50 219/202
10,429,099 B2 10/2019 Bohlender et al.
(Continued)

FOREIGN PATENT DOCUMENTS

DE 102012013770 1/2014
DE 202014006425 8/2014
(Continued)

*Primary Examiner* — Shawntina T Fuqua
(74) *Attorney, Agent, or Firm* — Boyle Fredrickson S.C.

(57) ABSTRACT

A PTC heating element for an electric heating device includes frame which is made of electrically non-conductive material and which encloses at least one PTC element, conductor tracks electrically connected to the PTC element, and insulating layers bearing, in a heat-conductive manner, against an oppositely disposed main side surface of the PTC element. The frame has contact strips which project over itself and which are electrically conductively connected to the conductor tracks for energizing the PTC element with different polarities. In order to provide an electrically well-insulated PTC heating element allows good heat coupling, s a film respectively covers the outer surfaces of the insulating layers. A corresponding PTC heating element may be provided in a circulation chamber of the electric heating device. In this case, the conductor tracks are electrically connected to the PTC element, protrude through a partition wall of the electric heating device, and are exposed and electrically connected in a connection chamber. The connection chamber is separated by the partition wall from the circulation chamber.

14 Claims, 4 Drawing Sheets

(58) Field of Classification Search
CPC ... H05B 3/03; H05B 3/14; H05B 3/12; H05B 3/141; H05B 3/0042; H05B 2203/02; H05B 2203/23; H05B 2203/016; H05B 1/0236; H05B 1/0244; F24H 9/2028; F24H 9/103; F24H 9/1827; F24H 1/09; F24H 3/0429; B60H 1/2215; B60H 1/2225
See application file for complete search history.

(56) References Cited

U.S. PATENT DOCUMENTS

| | | | | |
|---|---|---|---|---|
| 2008/0073336 | A1* | 3/2008 | Bohlender | F24H 3/0435 219/467.1 |
| 2008/0099464 | A1* | 5/2008 | Niederer | F24H 3/0429 219/520 |
| 2013/0015176 | A1* | 1/2013 | Twiney | H05B 3/141 219/494 |
| 2018/0160480 | A1* | 6/2018 | Bohlender | H05B 3/06 |
| 2018/0337506 | A1 | 11/2018 | Niederer | |

FOREIGN PATENT DOCUMENTS

| | | |
|---|---|---|
| DE | 102017206487 | 10/2018 |
| EP | 1253808 | 10/2002 |
| EP | 1395098 | 3/2004 |
| EP | 2607121 | 6/2013 |
| EP | 3334242 | 6/2018 |

* cited by examiner

PTC HEATING ELEMENT AND ELECTRIC HEATING DEVICE COMPRISING SUCH

BACKGROUND OF THE INVENTION

1. Field of the Invention

The present invention relates to a PTC heating element for an electric heating device, with frame made of electrically non-conductive material which encloses at least one PTC element, conductor tracks electrically connected to said PTC element, and insulating layers bearing in a heat-conductive manner against oppositely disposed main side surface of the PTC element. Such a PTC heating element is known from EP 3 334 242 A1. The present invention further relates to an electric heating device with at least one PTC heating element arranged in a circulation chamber and with a frame that joins at least one PTC element and contact strips energizing the PTC element as a structural unit. The contact strips there project over the frame and are electrically conductively connected to conductor tracks for energizing the PTC element with different polarities, for which purpose the frame typically receives and encloses contact plates which can preferably integrally form the contact strips. The electric heating device according to the invention further has a partition wall which separates the circulation chamber from a connection chamber, where contact strips of the PTC heating element protruding through the partition wall are exposed and electrically connected in the connection chamber.

2. Background of the Invention

An electric heating device of the aforementioned type is known, for example, from EP 2 607 121 A1 or also EP 3 334 242 A1.

In the electric heating device according to EP 2 607 121 A1, several PTC elements are received in a frame forming the heating element casing and are contacted on oppositely disposed main side surfaces by a contact plate, which are locked to the frame. At one face side, connection ports project beyond the heating element casing and are integrally formed onto the frame and over which sealing sleeves made of Teflon with a labyrinth seal provided on the outer peripheral surface are drawn. Insulating layers formed from plastic film are respectively applied to the outer side of the contact plates facing away from the PTC elements.

Known also from EP 1 253 808 A1 and EP 1 395 098 A1, respectively, are similar generic PTC heating elements and generic heating devices. In this prior art, the contact plate is injection mold coated at least on one side together with the insulating layer during the production of the heating element casing, so that only the PTC elements are inserted into the opening of the frame and are to be covered on the opposite side by the contact plate and the insulation.

Although such a configuration represents a simplification in terms of production technology as compared to the previously described prior art, the design is still relatively bulky and complex.

SUMMARY

The present invention relates in particular to an electric heating device for a motor vehicle as well as to a PTC heating element of such an electric heating device. Such components have always been designed to be optimized in terms of weight. Furthermore, due to the high number of units in the motor vehicle industry, it must be ensured that it can be manufactured economically. For electric heating devices with PTC heating elements, it is further preferable to provide configurations which allow heat dissipation of the heat generated in the PTC element to be as good and symmetrical as possible. Furthermore, good insulation of the energized elements of the PTC heating element in the frame is important, in particular for motor vehicles operated at a high voltage, i.e. electrically driven motor vehicles. Because the PTC heating element is typically operated at high voltage in an electrically operated vehicle.

The present invention is based on the object of specifying a PTC heating element and an electric heating device with at least one PTC heating element which allow for good heat decoupling while having a good insulation of the electrified parts surrounded by the frame.

To satisfy this object, a PTC heating element has a frame which is made of an electrically non-conductive material and which encloses at least one PTC element. Conductor tracks are electrically connected to the PTC element, and insulating layers bear, in a heat-conductive manner, against oppositely disposed main side surface of the PTC element. The contact strips project over the frame and are electrically conductively connected to conductor tracks for energizing the PTC element with different polarities, for which purpose the frame typically receives and encloses contact plates which may integrally form the contact strips.

The frame typically fully circumferentially surrounds the PTC element and insulating layers bearing thereagainst on both sides. The frame encloses the edge surfaces of the insulating layers. The PTC element is typically located within a frame opening. Sometimes the edge regions of the PTC element can also extend up to the struts forming the frame.

In the previously mentioned prior art according to EP 3 334 242 A1, the plastic material forming the frame encompasses the insulating layers at the edge, so that the insulating layers are sealed fully circumferentially by the frame. Nevertheless, the problem arises that a leak can occur at the surface of the insulating layer between the insulating layer formed from ceramic material and the frame strut and the sealing lip formed by the frame strut. This enables fouling and moisture to reach the energized elements of the PTC heating element.

This is where the present invention provides a remedy by proposing to provide the insulating layer on the outer side with a film which typically runs strictly parallel to the main side surfaces of the PTC element and the insulating layer applied thereonto. The PTC element is then fully encapsulated by the frame and the film. However, the film is a thin-walled film, so that the heat can be dissipated without great heat resistance perpendicular to the main side surface of the PTC element through the insulating layer and through the film which typically forms the outer surface of the PTC element.

The frame is typically made of plastic material, for example of silicone or other heat-resistant and yet elastic plastic material. The frame is preferably formed with the film as a structural unit, for example, in that the PTC element, the conductor tracks, as well as the insulating layers disposed opposite the main side surfaces of the PTC element are injection mold coated with the material forming the frame. The current-conducting parts of the PTC heating element are then connected to the frame in a sealed manner by overmolding, i.e. insert molding.

However, the film is there formed preferably also on the respective outer surfaces of the insulating layers. With the solution of the invention, the insulating layer is preferably an insulating layer made of ceramic material, in particular a ceramic plate, which is preferably formed from aluminum oxide. The relatively brittle and thin ceramic can have cracks, so that with the solution according to the invention, the outer surface of the PTC element is protected from ingress of fouling or moisture by the film and the struts of the frame circumferentially surrounding the PTC element, also in case of a leak of the insulating layer. Also, the problem of a leak of the sealing lip formed by the frame material on the surface of the insulating layer, as known from previously mentioned prior art, does not exist.

The film completely covers the insulating layers on both main side surfaces of the frame. It transitions completely to the struts of the frame. The film and the frame are preferably formed from identical material.

Where the film is thin. It typically has a thickness of no more than 100 microns, preferably no more than 50 microns, particularly preferably no more than 20 microns. A lower limit for the layer thickness is generally not required. What is essential is that the film is applied to the insulating layer over the entire surface and is connected to the frame in a sealing manner. In any case, a minimum thickness of the film in a range of 5 microns to 10 microns is considered to be sufficient.

Also with the present invention, the two conductor tracks are preferably formed from a punched sheet of metal which forms not only the conductor tracks but also the contact strip as a unit. The contact strips penetrate the frame and project thereover on the outer side. The remaining length section of the contact plates is provided within the frame.

According to one preferred further development of the present invention, the frame struts surrounding the insulating layers and the PTC element project over the film on both sides in the thickness direction of the PTC heating element. The thickness direction extends perpendicular to the main side surface of the PTC element. In other words, the frame struts form a fully circumferential frame for the insulating layer and the PTC element and thus a frame opening, relative to which the film is recessed inwardly on both sides toward the PTC element. The frame struts accordingly form the chassis or heating element casing, respectively, of the PTC heating element. They create the structural integrity of the PTC heating element. The film may be formed adapted only with regard to the desired seal of the main side surface of the PTC element or the insulating layer, respectively. The thinner the film, the better the heat dissipation through the film in the thickness direction of the PTC heating element. Heat decoupling from the PTC heating element therefore typically takes place largely, if not exclusively, via the main side surfaces and not the edge surfaces of the PTC element which join the two main side surfaces to each other.

According to one preferred further development of the present invention, the film is connected to the insulating layer in a positive substance-fit manner. This results in improved heat decoupling as compared to the case, in which the PTC heating element, the insulating layers bearing on two sides against the main side surfaces thereof, and the two films are merely layered. In view of the best possible heat decoupling through the main side surfaces of the PTC element, the latter is further preferably connected to the insulating layer in a positive substance-fit manner, for example adhesively bonded or soldered.

According to one further preferred configuration of the present invention, a core made of electrically insulating material is provided, through which the contact strips protrude and which is received in the frame. The core can be limited to that strut of the frame through which the contact strips protrude and project over perpendicularly. The core typically consists of hard plastic material, such as PP, PE or PA The core is typically surrounded by resiliently soft plastic material or injection mold coated therewith, which can be formed in the region of the core as a labyrinth seal. The core thus provides a certain resistance during the insertion of the respective frame struts into a female plug contact holding fixture which is formed by the partition wall of the electric heating device. The PTC heating element can then in a sealing manner be inserted into the partition and held therein by being plugged in. This prevents the fluid to be heated from entering the connection chamber from the circulation chamber.

The PTC heating element may have a metal structure that is formed permeable to fluid, such as to water, and defines an electromagnetic shielding around the PTC element and the conductor tracks. The metal structure permeable to fluid offers the possibility that the fluid to be heated can directly reach the heat-dissipating surface of the PTC heating element. Unlike in prior art according to DE 10 2012 013 770 A1, the heat generated by the PTC element then does not first have to pass through a closed shielding shell in order to be released to the medium. The metal structure may surround the PTC heating element and the conductor tracks as a cage. The metal structure is connected to the potential of the ground, whereas the two conductor tracks are assigned to the potential of the power current.

The medium to be heated with the PTC heating element according to the invention, can be air or a liquid heat carrier, for example water. The PTC element can be installed in an air heater, so that a corrugated rib layer dissipating the heat to the air can be abutted directly against the metal structure. A possible electrical insulation between the electrically conductive components of the PTC heating element, namely the PTC element and the two conductor tracks, can be provided within the shielding. This insulation prevents the medium to be heated from coming into direct contact with the electrically conductive components of the PTC heating element conducting the power current.

The PTC heating elements of the present invention are exposed in the circulation chamber in the manner of heating ribs. The metal structure permeable to fluid there surrounds the heat-dissipating surface of the PTC heating element with a small spacing, so that a flow gap between the shielding and the heat-dissipating surface arises. Improved heat transfer in this flow gap has been shown over known solutions, since the fluid flow is given a turbulence by the metal structure, resulting in improved heat transfer at the boundary surface, i.e. the heat-dissipating surface, of the heat-generating PTC heating element. The shielding may be spaced at least in sections from the heat-dissipating surface that is connected in a heat-conductive manner to the PTC element. The spacing is typically between 1.0 and 4.0 millimeters. With such a spacing, the flow in the gap can be adjusted in the best possible manner with regard to the desired intensive heat transfer between the heat-dissipating surface and the medium to be heated.

Various metal structures, such as metal knit fabrics, metal fabrics or even expanded metal sheets, are suitable for the previously mentioned turbulence effect of the fluid to be heated. Also conceivable are textile structures which entirely or in part contain metallic threads, possibly also receive textile threads or are formed therefrom. The mesh size between individual metallic elements of the metal structure permeable to fluid is determined by the desired effect of the shielding. However, the respective mesh size should not be less than 1.0 millimeter. For the desired shielding, the individual elements of the metal structure can be aligned as closely to each other as desired. Also, for example, densely woven metal structures are basically permeable to fluid. In view of good convective heat dissipation, a minimum mesh size should not be underrun. The minimum spacing from adjacent fiber or thread elements or expanded metal structures of the metal structure should not be less than 1.0 millimeter. With regard to a good turbulence for generating turbulent flows at the heat-dissipating surface of the PTC element, on the one hand, and a good flowability for convective dissipation of heat, on the other hand, the optimum is possible with a mesh width of between 1.5 and 2.0 millimeters, preferably between 3 and 10 millimeters. In view of the stability and in particular the processability and taking into account the desired mesh size, the wire thickness should be between 0.2 and 0.5 millimeters. Such wire thicknesses are well woven and available as standard products. In the undulating region, the wire thickness should be chosen having a thickness of 0.4 to 1 millimeter.

According to its second aspect, the present invention specifies an electric heating device having a PTC heating element as described above. The frame and the film may be formed by injection molding an electrically insulating plastic material around the PTC element, the insulating layers, and the conductor tracks. An electromagnetic shielding may be formed from a metal structure that is permeable to fluid and surrounding the PTC element and the conductor track. At least one shielding connection lug may be connected in an electrically conductive manner to the shielding and extend parallel to the contact strips and project over the shielding.

As previously discussed, the PTC heating element can be inserted into the partition wall and/or held therein in a sealing manner like a male plug-in element. For this purpose, the PTC heating element, at least in the region of the plug-in contact, is typically provided with sealing lips or slats which interact in a sealing manner with a female plug contact holding fixture which is formed by the partition wall.

BRIEF DESCRIPTION OF THE DRAWINGS

Further details and advantages of the present invention shall become apparent from the following description of embodiments in combination with the drawing, in which.

DETAILED DESCRIPTION

Figure 1:
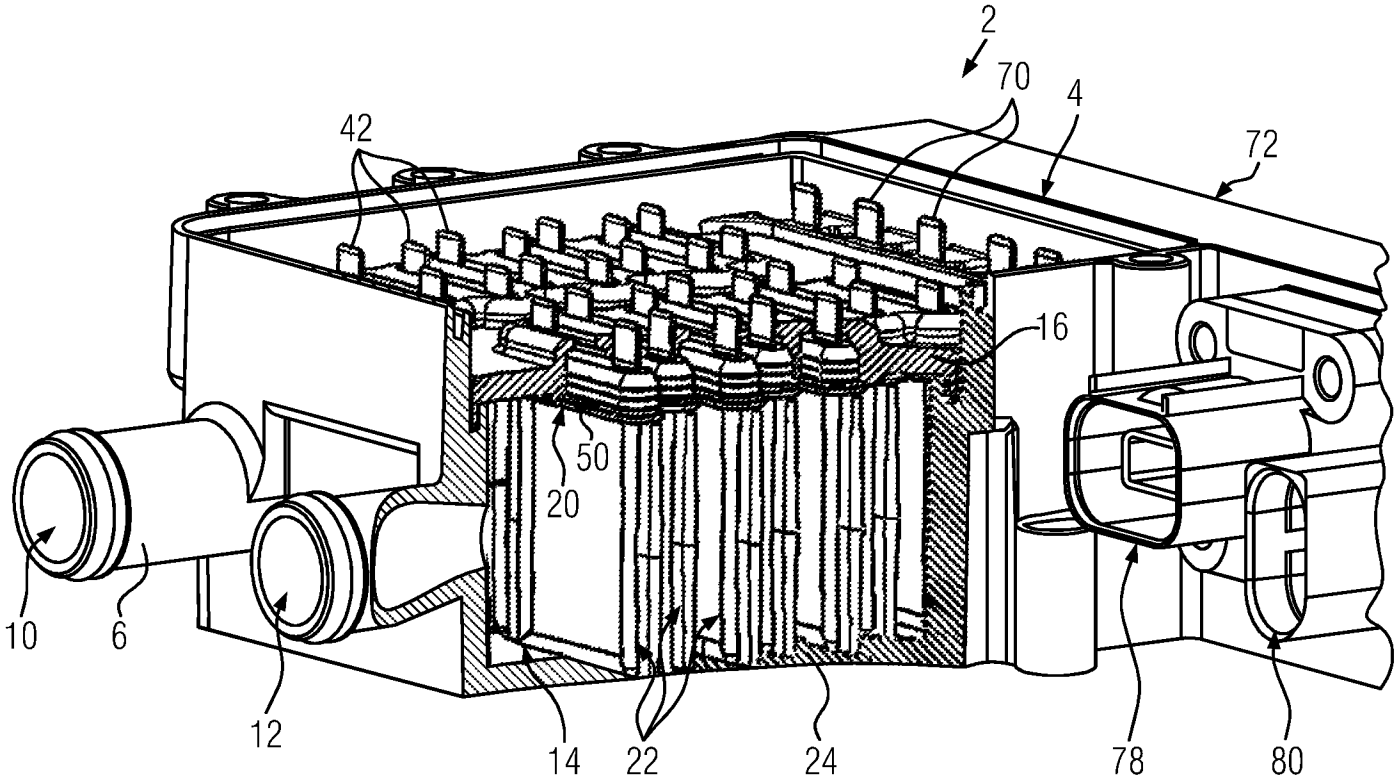
FIG. 1 shows a perspective side view of an embodiment of an electric heating device.

FIG. 1 shows a perspective top view of a casing, designated by reference numeral 2, of an electric heating device configured as a water heater. The heater casing 2 has a casing tub element 4 made of plastic material. The casing 2 forms an inlet port 6 and an outlet port 8 which are presently embodied formed integrally on the casing tub element 4. The ports 6, 8 are designed as hose connection ports and form an inlet opening 10 and an outlet opening 12, respectively, to a circulation chamber designated with reference numeral 14.

The circulation chamber 14 is separated from a connection chamber 18 and sealed thereagainst by a partition wall 16 made of plastic material. The partition wall 16 forms female plug element holding fixtures 20 for PTC heating elements 22 which are inserted into the female plug element holding fixtures 20 in a sealed manner and supported on a base 24 of the casing tub element 4.

Figure 3:
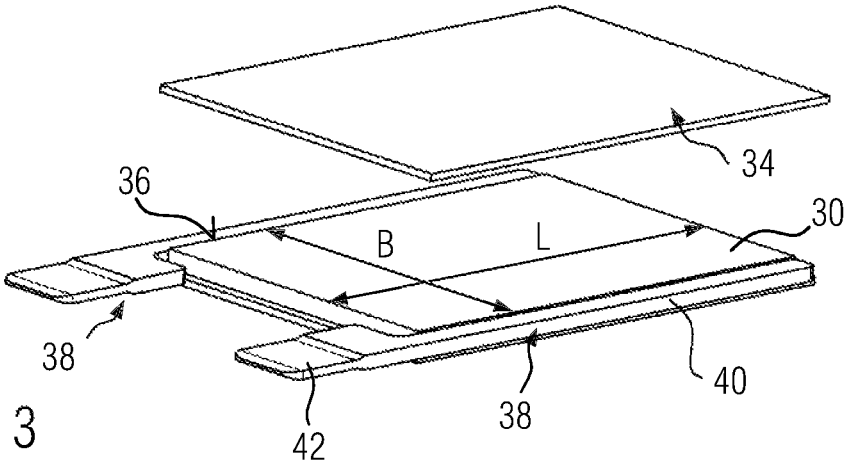
FIG. 3 shows a perspective side view of parts of a PTC heating element.
Figure 4:
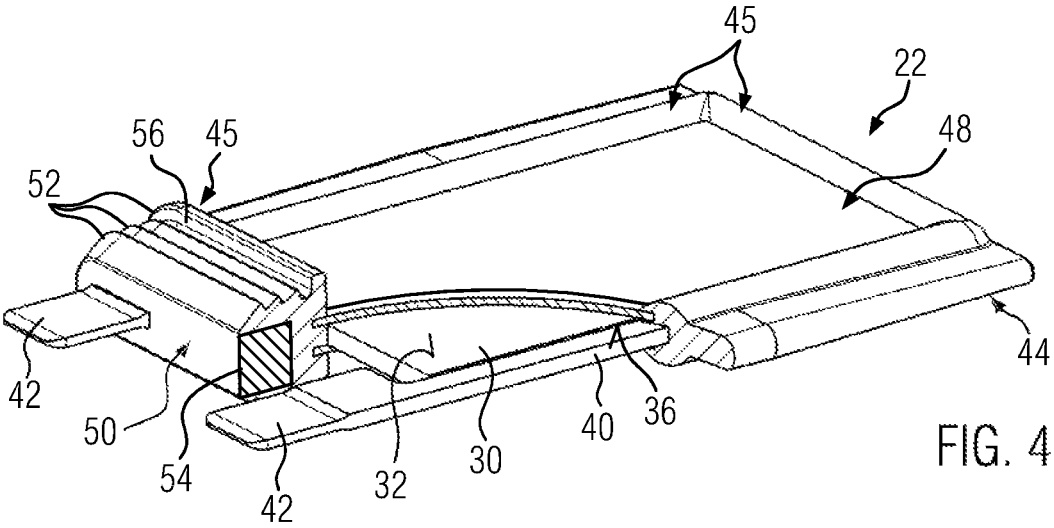
FIG. 4 shows a partially broken perspective side view of the PTC heating element.
Figure 5:
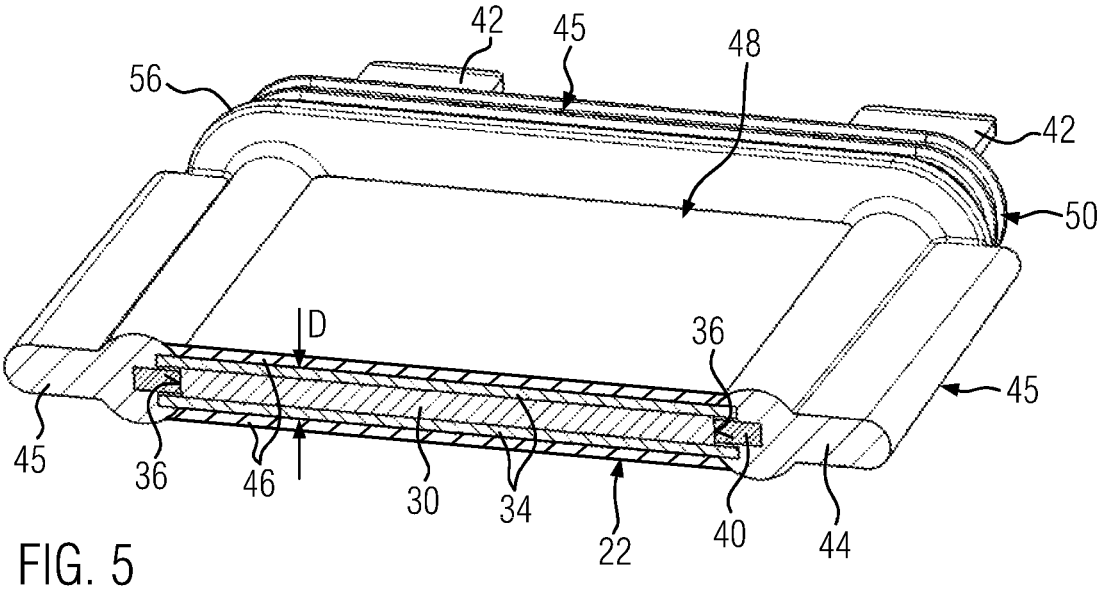
FIG. 5 shows a perspective cross-sectional view of the PTC heating element.

FIGS. 3 to 5 illustrate details of the PTC heating element 22 which presently comprises only one PTC element 30 which at its oppositely disposed main side surfaces 32 is covered with an insulating layer 34. The insulating layer 34 is presently a ceramic plate made of aluminum oxide. However, it can also be applied as a coating onto the PTC element 30 or as a combination of a coating with a single or multiple layer insulation coat. The PTC element 30 is designed as a platelet having a width B or a length L, respectively, that is greater by the factor of at least 10 than the thickness D which corresponds to the distance between the two main side surfaces 32. Sheet metal strips 38 substantially extending in the direction of the length L are provided on mutually oppositely disposed face side surfaces 36 and are glued to the PTC element 30 and are connected in an electrically conductive manner to a surface metallization of the PTC element 30 which can be applied as a layer by way of PVD or CVD. The sheet metal strips 38 consist of a contact ridge 40 which is relatively narrow and the contact strip 42 which is widened in relation to the contact ridge 40 in the direction of the width B.

The contact ridges 40 presently form the conductor tracks to the PTC element 30 and are electrically connected to the metallization of the PTC element 30. The sheet metal strip 38 is provided such that it does not project over the main side surfaces 32 of the PTC element 30 at any point. As can be seen in FIGS. 4 and 5, the insulating layers 34 project laterally over the PTC element 30. The insulating layers 34 accordingly have a base area which is larger than the base area of the main side surfaces 32 of the PTC element 30. Accordingly, the outer edges of the insulating layers 34 receive the contact ridge 40 between themselves on both sides (see FIG. 5). The insulating layer 34 is glued to the PTC element 30. The insulating layer 34 bears directly onto the PTC element. One of the insulating layers 34 therefore directly contacts the associated main side surface 32 of the PTC element 30.

Alternatively, the sheet metal strip 38 can be applied according to the invention entirely or in part as a contact plate flat on the main side surface 32. With regard to good heat decoupling perpendicular to the main side surface 32, however, the variant discussed in the context of the embodiment is to be preferred.

The sheet metal strip 38 is largely received in a frame 44 made of insulating material which surrounds the PTC element 30 on all four circumferential sides. The frame 44 has four frame struts 45. This frame 44 circumferentially encloses the circumferential edges of the insulating layers 34. The contact ridges 40 are also encapsulated by the material forming the plastic frame 44. The frame 44 is formed by injection molding around an elastomer material, in particular silicone.

With the completed PTC heating element 22, only the contact strips 42 project over the frame 44 on a face side. All other functional parts of the PTC heating element 22 used for heat generation and current conduction are accommodated within the frame 44. As visualized in particular by FIGS. 4 and 5, the frame 44 integrally forms a film 46 which is provided plane-parallel to the insulating layer 34 and connected thereto in a positive substance-fit manner. The insulating layers 34 provided there are each covered on both main side surfaces by the film 46 over the entire surface. Each film 46 transitions completely to the frame 44. The film 46 has a thickness, i.e. extension perpendicular to the main side surface 32, of no more than 50 microns, preferably no more than 20 microns.

As illustrated in particular by FIG. 5, the PTC element 30, the insulating layer 34, and the film 46 are located behind a frame opening designated with reference numeral 48 and formed by the frame 44. The frame 44, i.e. the frame struts 45, are accordingly thicker than the sum of the thicknesses of PTC element 30, the two insulating layers 34, and the two layers of the film 46.

Almost no overlap of the frame 44 with the main side surfaces 32 of the PTC element 30 presently arises at all so that the latter is located in the frame openings 46 with almost 100% of its main side surfaces 32 covered by the film 46 and the insulating layer 34.

The frame 44 forms a sealing collar 50 which is provided with sealing lips 52 arranged tapering conically toward the free end of the contact strips 42. Three of these sealing lips 52 are presently provided one behind the other in the direction of longitudinal extension of the contact strip 42 as a kind of labyrinth seal. The sealing collar 50 made of the resiliently soft plastic material is injection molded around a core 54 made of an electrically insulating plastic material which comprises passage openings, not shown, for passing the widened regions of the sheet metal strips 38 through and is used for the pre-assembly of the sheet metal strips 38. This core 54 increases the pressing force of the sealing collar 50 during the insertion into the female plug element holding fixture 20.

The sealing collar 50 is defined at the underside by a circumferential annular stop 56 which after insertion of the PTC heating element 22 into the female plug element holding fixture 44 bears in a sealing manner against an abutment bead formed by the partition wall 16.

Figure 2:
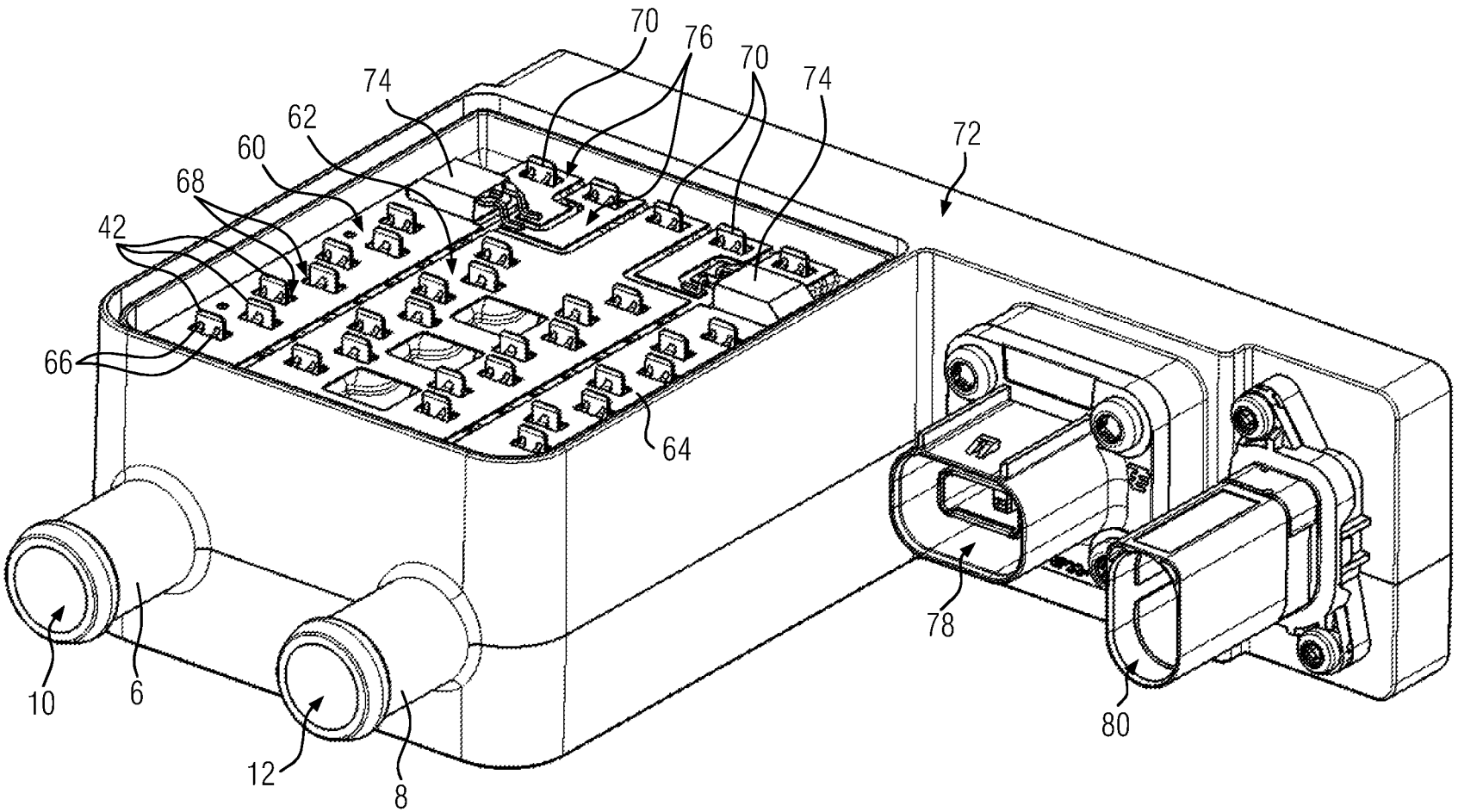
FIG. 2 shows a perspective side view of the embodiment according to FIG. 1 after connection of the PTC heating elements.

FIG. 2 illustrates the electrical connection of the PTC heating elements 22. For the electric connection, pieces of sheet metal are provided in the connection chamber 18 as current bars 60, 62, 64, comprising contact projections 66 formed by punching and bending which bear against the contact strips 42 subject to resilient prestress and contact them. The contact projections 66 project into receptacle openings 68 which are recessed in the sheet metal strips of the current bars 60, 62, 64. Connection strips marked with reference numeral 70 are connected in the same way and are contacted to a fitted circuit board which is accommodated in a control casing 72. The connection of the current bar 62 is there established directly via the connection strip 70, whereas the connection of the current bars 60, 64 is established via a power transistor 74 which is contacted by punched conductors 76 which are electrically connected to the associated connection strips 70.

The control casing 72 comprises a connector casing 78 for the power current and a connector casing 80 for the connection of cables for the control signals.

Figures 6, 7, 8:
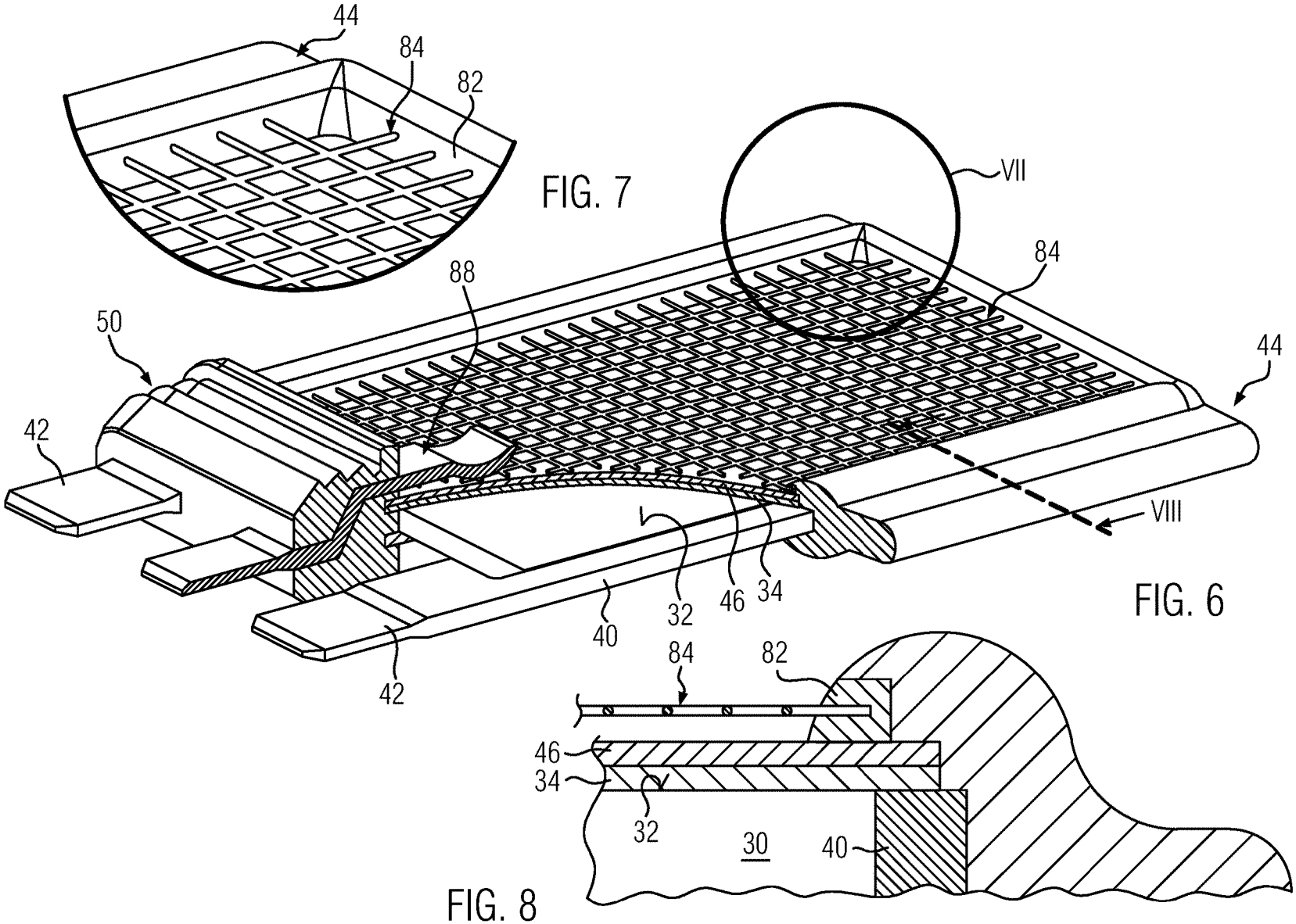
FIG. 6 shows a perspective and partially cut side view of a second embodiment of a PTC heating element.
FIG. 7 shows detail VII according to FIG. 6 in an enlarged representation and FIG. 8 shows a sectional view taken along line VIII-VIII according to FIG. 6.

FIGS. 6 to 8 show an alternative embodiment of a PTC heating element. The same components are given the same reference numerals as in to the previously discussed embodiment. The embodiment has a frame 44 which also forms a sealing collar 50 that is formed integrally thereon and that can be inserted into in the casing 2 in a sealing manner as described in DE 10 2016 224 296 A3. As can be seen, the outer surfaces of the plastic material defining the frame 44 has been injected during injection molding around a holding frame 82 which encloses a presently planar metal structure 84 at the edge which forms an electromagnetic shielding. The corresponding holding frame 82 is first connected to the metal structure 84 and placed as an insert member into the injection mold. The holding frame 82 defines the cavity at the inner circumference for the formation of the frame 44.

The contact strips 42 are presently formed by elongated sheet metal strips 38 which at the face side bear against and energize the PTC element 39. The main side surface 32 of the PTC element 30 decoupling the heat on the outer side is covered with the insulating layer 34 and the film 46 which are sealed at the edge into the material of the heating element casing 2.

The sealing collar 50 is penetrated by a contact plate 86 which is made of sheet metal material by punching and bending and forms a contact section 88, protruding on both sides in the direction towards the metal structure 84, which is connected to the metal structure 84 in an electrically conductive manner. By connecting a shielding connection lug 90 formed by the contact plate 86, it is possible to electrically connect the metal structure 84 provided on a main side surface 32 to a shielding pol.

The embodiment shown in FIGS. 6 to 8 has two identically formed contact sections 88 which are each connected to the oppositely disposed main side surfaces 32 to the metal structure 84 provided there as a flat metal fabric and of which only the contact section 88 of the upper side is shown.

We claim:

1. A PTC heating element for an electric heating device comprises:

a frame which is made of an electrically non-conductive material and which encloses at least one PTC element, conductor tracks which are electrically connected to the PTC element, and insulating layers bearing, in a heat-conductive manner, against oppositely disposed main side surface of the PTC element, wherein the frame has contact strips projecting over itself which are electrically conductively connected to the conductor tracks for energizing the PTC element with different polarities, and wherein a film covers the outer surfaces of the insulating layers.

2. The PCT heating element according to claim 1, wherein the frame and the film are formed as a structural unit.

3. The PTC heating element according to claim 2, wherein the frame and the film are formed by injection molding an electrically insulating plastic material around the PTC element, the insulating layers, and the conductor tracks.

4. The PTC heating element according to claim 1, wherein the frame comprises the insulating layer and frame struts which circumferentially surround the PTC element and which project over the film in a thickness direction of the PTC heating element outwardly on both sides.

5. The PTC heating element according to claim 1, wherein the frame and the film are formed from silicone.

6. The PTC heating element according to claim 5, wherein the film is connected in a positive substance-fit manner to the insulating layer.

7. The PTC heating element according to claim 3, wherein a core is provided which made of electrically insulating material, through which the contact strips protrude, and which is received in the frame.

8. The PTC heating element according to claim 1, further comprising an electromagnetic shielding which is formed from a metal structure, which is permeable to fluid, and which surrounds the PTC element and the conductor track.

9. The PTC heating element according to claim 8, further comprising at least one shielding connection lug that is connected in an electrically conductive manner to the shielding, that extends parallel to the contact strips, and that projects over the shielding.

10. A PTC heating element for an electric heating device, comprising:

a frame which is made of electrically non-conductive material and which encloses at least one PTC element, conductor tracks which are electrically connected to the PTC element, and insulating layers which bear, in a heat-conductive manner, against oppositely disposed main side surface of the PTC element, wherein the frame has contact strips which project over itself and which are electrically conductively connected to the conductor tracks for energizing the PTC element with different polarities, further comprising a film respectively covering the outer surfaces of the insulating layers, wherein the frame and the film are formed by injection molding an electrically insulating plastic material around the PTC element, the insulating layers, and the conductor tracks, and further comprising 1) an electromagnetic shielding that is formed from a metal structure, that is permeable to fluid, and that surrounds the PTC element and the conductor track, and 2) at least one shielding connection lug which is connected in an electrically conductive manner to the shielding and which extends parallel to the contact strips and projects over the shielding.

11. The PTC heating element according to claim 10, wherein the frame comprises the insulating layer and frame struts which circumferentially surround the PTC element and which project over the film in a thickness direction of the PTC heating element outwardly on both sides, wherein the frame and the film are formed from silicone, and further comprising a core which is made of electrically insulating material, through which the contact strips protrude, and which is received in the frame, wherein the core is surrounded by the resiliently soft plastic material.

12. The PTC heating element according to claim 11, further comprising 1) an electromagnetic shielding which is formed from a metal structure, which is permeable to fluid, and which surrounds the PTC element and the conductor track, and 2) and at least one shielding connection lug which is connected in an electrically conductive manner to the shielding, which extends parallel to the contact strips, and which projects over the shielding.

13. An electric heating device comprising at least one PTC heating element which is arranged in a circulation chamber, the PTC heating element including a frame which joins at least one PTC element and contact strips as a structural unit, wherein the contact strips energize the PTC element, are electrically connected to the PTC element, and project over itself, and further comprising a partition wall which separates the circulation chamber from a connection chamber in which the contact strips of the PTC element, protruding through the partition wall, are exposed and electrically connected, wherein the PTC heating element comprises a frame which is made of an electrically non-conductive material and which encloses at least one PTC element, conductor tracks which are electrically connected to the PTC element, and insulating layers bearing, in a heat-conductive manner, against oppositely disposed main side surface of the PTC element, wherein a film covers the outer surfaces of the insulating layers.

14. The electric heating device according to claim 13, wherein that the PTC heating element is inserted into the partition wall in a sealing manner.

* * * * *